US005734365A

United States Patent [19]

Ohno et al.

[11] Patent Number: 5,734,365

[45] Date of Patent: Mar. 31, 1998

[54] LIQUID CRYSTAL DISPLAY APPARATUS

[75] Inventors: Tomoyuki Ohno; Kazunori Katakura, both of Atsugi; Manabu Iwasaki, Yokohama, all of Japan

[73] Assignee: Canon Kabushiki Kaisha, Japan

[21] Appl. No.: 786,287

[22] Filed: Jan. 22, 1997

[30] Foreign Application Priority Data

Jan. 25, 1996 [JP] Japan ..... 8-030084

[51] Int. Cl.[6] ..... G09G 3/36

[52] U.S. Cl. ..... 345/97; 345/103; 345/208

[58] Field of Search ..... 345/97, 99, 103, 345/94, 87, 96, 208, 209, 55, 50, 51, 60; 349/33, 37; 348/790, 792

[56] References Cited

U.S. PATENT DOCUMENTS

| | | | |
|---|---|---|---|
| 4,367,924 | 1/1983 | Clark et al. | 350/334 |
| 5,049,865 | 9/1991 | Nakamura et al. | 345/60 |
| 5,321,419 | 6/1994 | Katakura et al. | 345/97 |
| 5,469,281 | 11/1995 | Katakura et al. | 359/56 |
| 5,471,229 | 11/1995 | Okada et al. | 345/89 |
| 5,519,411 | 5/1996 | Okada et al. | 345/89 |
| 5,521,727 | 5/1996 | Inaba et al. | 359/56 |
| 5,532,713 | 7/1996 | Okada et al. | 345/97 Y |
| 5,583,534 | 12/1996 | Katakura et al. | 345/97 |
| 5,592,190 | 1/1997 | Okada et al. | 345/89 |
| 5,592,191 | 1/1997 | Tsuboyama et al. | 345/97 |
| 5,598,229 | 1/1997 | Okada et al. | 348/792 |
| 5,606,343 | 2/1997 | Tsuboyama et al. | 345/97 |
| 5,627,559 | 5/1997 | Tsuboyama et al. | 345/97 |
| 5,654,732 | 8/1997 | Katakura | 345/97 |

FOREIGN PATENT DOCUMENTS

| | | |
|---|---|---|
| 56-107216 | 8/1981 | Japan . |
| 63-155032 | 6/1988 | Japan . |
| 02281233 | 11/1990 | Japan . |

*Primary Examiner*—Dennis-Doon Chow

*Attorney, Agent, or Firm*—Fitzpatrick, Cella, Harper & Scinto

[57] ABSTRACT

A liquid crystal display apparatus for presenting a high-quality image at a reduced power consumption comprises a liquid crystal display panel having scanning-signal electrodes and information-signal electrodes arranged in a matrix configuration, liquid crystals interposed between the scanning-signal electrodes and the information-signal electrodes, information electrode driving means for applying an information-signal voltage waveform to the information-signal electrodes, and scanning electrode driving means for applying a scanning-signal voltage waveform to the scanning-signal electrodes. The frequency of information-signal voltage waveform is lowered without changing the frame frequency of the apparatus by allowing two lines of scanning-signal electrodes to scan during a write pulse having a pulse length of ΔT within one scanning period to select presentations of two pixels for each information-signal electrode.

9 Claims, 10 Drawing Sheets

FIG. 7

| (n = 0, 1, 2, ···· ) | FIRST FIELD | SECOND FIELD | THIRD FIELD | FOURTH FIELD |
|---|---|---|---|---|
| (8n+1)TH ELECTRODE | COM1 | | | |
| (8n+2)TH ELECTRODE | COM2 | | | |
| (8n+3)TH ELECTRODE | | | COM1 | |
| (8n+4)TH ELECTRODE | | | COM2 | |
| (8n+5)TH ELECTRODE | | COM1 | | |
| (8n+6)TH ELECTRODE | | COM2 | | |
| (8n+7)TH ELECTRODE | | | | COM1 |
| (8n+8)TH ELECTRODE | | | | COM2 |

FIG. 8

| (n = 0, 1, 2, ···· ) | FIRST FIELD | SECOND FIELD | THIRD FIELD | FOURTH FIELD |
|---|---|---|---|---|
| (8n+1)TH ELECTRODE | COM1 | | | |
| (8n+2)TH ELECTRODE | | COM1 | | |
| (8n+3)TH ELECTRODE | | | COM1 | |
| (8n+4)TH ELECTRODE | | | | COM1 |
| (8n+5)TH ELECTRODE | COM2 | | | |
| (8n+6)TH ELECTRODE | | COM2 | | |
| (8n+7)TH ELECTRODE | | | COM2 | |
| (8n+8)TH ELECTRODE | | | | COM2 |

FIG. 9

| (n = 0, 1, 2, ···· ) | FIRST FIELD | SECOND FIELD | THIRD FIELD | FOURTH FIELD |
|---|---|---|---|---|
| (8n+1)TH ELECTRODE | COM1 | | | |
| (8n+2)TH ELECTRODE | | | | COM1 |
| (8n+3)TH ELECTRODE | | COM1 | | |
| (8n+4)TH ELECTRODE | | | COM1 | |
| (8n+5)TH ELECTRODE | COM2 | | | |
| (8n+6)TH ELECTRODE | | | | COM2 |
| (8n+7)TH ELECTRODE | | COM2 | | |
| (8n+8)TH ELECTRODE | | | COM2 | |

LIQUID CRYSTAL DISPLAY APPARATUS

BACKGROUND OF THE INVENTION

1. Field of the Invention

The present invention relates to a display apparatus for presenting characters and images and, more specifically, to a matrix display apparatus that presents an image through two alignment states of liquid crystals.

2. Related Background Art

LCD (liquid-crystal display) flat-panel displays today are capturing widespread attention. The LCD flat-panel display is flat, light-weight and has low power consumption when compared with CRT displays that have heretofore been widely used.

Although the LCD flat-panel display consumes less power than a CRT display, even greater power savings would be desirable in view of the benefits of a more effective use of energy.

Among other LCD devices used in the flat-panel displays, ferroelectric liquid crystal devices featuring bistable modes and fast response characteristic to electric field are expected to achieve widespread use as a high-speed and memory type display device, and one type of ferroelectric liquid crystal devices is disclosed in Japanese Unexamined Patent Publication No. 56-107216. Furthermore, a number of methods for matrix-driving such displays have been proposed, for example, in Japanese Patent Unexamined Publication No. 2-281233. FIG. 10 shows the waveforms used in one of the known driving methods. As shown in FIG. 10, A represents a scanning-signal voltage waveform to be applied during a selection period; B represents a scanning-signal voltage waveform to be applied during a non-selection period; C represents an information-signal voltage waveform for a light display state; and D represents an information-signal voltage waveform for a dark display state. 1H represents one horizontal scanning period for determining the presentation statuses of pixels on a single line of scanning electrodes.

When a presented image is rewritten or updated in known ferroelectric liquid crystal devices, information voltages shown in C and D in FIG. 10 are applied to information-signal electrodes (more simply referred to as information electrodes) to heighten the frame frequency, while scanning-signal voltages during selection period are applied to scanning-signal electrodes (more simply referred to as scanning electrodes) that are to be updated, thereby presenting a light display state or a dark display state on the screen.

As displays become larger and utilize high definition screens, the load for driving a liquid crystal panel will increase, the power consumption of the apparatus will increase, the heat generation of the liquid crystal panel will increase, and the driving margin of the liquid crystal panel will decrease due to the effect of temperature characteristic of the liquid crystal materials. Furthermore, presentation quality of the liquid crystal panel display will be degraded in its high operating temperature region particularly when the entire screen presents a light display state. Japanese Unexamined Patent Publication No. 63-155032 discloses a method in which two scanning line electrodes are addressed. In this disclosed method, however, the frame period is prolonged and flickering is difficult to control.

SUMMARY OF THE INVENTION

Accordingly, it is an object of the present invention to provide a liquid crystal display apparatus that presents a high definition image with low power consumption.

To achieve the above object, the liquid crystal display apparatus of the present invention comprises a liquid crystal display panel having scanning-signal electrodes, information-signal electrodes and liquid crystals, information electrode driving means for applying an information-signal voltage waveform to the information-signal electrodes, and scanning electrode driving means for applying a scanning-signal voltage waveform to the scanning-signal electrodes, wherein the information-signal voltage waveform applied to the information-signal electrodes is constructed of a first information-signal voltage waveform (when the two pixels at the intersections where one information-signal electrode crosses two scanning-signal electrodes present a light display state and a dark display state, respectively, or a dark display state and a light display state, respectively) comprising a first information pulse (for light/dark selection) having a pulse length (width) of $\Delta T$, and a second information pulse following the first information pulse, having a polarity opposite the polarity of the first information pulse and having a pulse length of $\Delta T$, and a second information-signal voltage waveform (the above pixels presenting a light display state and a dark display state, respectively, or a dark display state and a light display state, respectively) comprising a third information pulse having a pulse length of $2\Delta T$. The scanning-signal voltage waveform applied to the scanning-signal electrodes is constructed of a first scanning-signal voltage waveform comprising a first write pulse having a pulse length of $\Delta T$ and a first erase pulse prior to the first write pulse, and a second scanning-signal voltage waveform, phase-shifted off the first scanning-signal voltage waveform by $\Delta T$, comprising a second write pulse having a pulse length of $\Delta T$ and a second erase pulse prior to the second write pulse. Two lines of the scanning-signal electrodes are allowed to scan concurrently on the liquid crystal panel according to the first and second scanning-signal voltage waveforms, and one of the first and second information-signal voltage waveforms is applied to each information-signal electrode in accordance with the presentation status of the information-signal electrode.

According to the present invention, two scanning lines are sequentially selected during one horizontal scanning period so that two pixels are selected for presentation on each information-signal electrode. In the information electrode driving means, the pulse length of the information-signal voltage waveform, the length of the information pulse portion (of the second information-signal voltage waveform) when two pixels on the same information-signal electrode present a light display and a light display, respectively, or a dark display and a dark display, respectively, and the like are lengthened. The frequency of the information-signal voltage waveform is thus lowered. The power consumption of the information electrode driving means is thus reduced. The reduction of the driving margin attributed to temperature rise of the liquid crystal and degradation of presentation quality of the liquid crystal are thus prevented. Although one horizontal scanning period is doubled, two scanning lines are sequentially scanned during one horizontal scanning period, one write time for one screen (namely, frame frequency) remains unchanged from that of the prior art. Since the scanning electrode driving means drives two scanning electrodes concurrently, it appears that the power consumption of the scanning electrode driving means itself is doubled. By lowering the frequency of the driving waveform, however, the actual power consumption of the scanning electrode driving means is kept almost equal to that in the prior art. Furthermore, the scanning electrode driving means drives two scanning lines at a time among several hundred scanning lines, its consumption is less than one tenth the power consumption of the information electrode driving means that drives all information-signal electrodes every horizontal scanning period. Even if there is some increase, its amount is negligibly small compared with the overall power consumption of the entire apparatus.

In the first information-signal voltage waveform, the first information pulse and the second information pulse are equal in pulse length and opposite in phase. Therefore, the average voltage of the information pulse portion is zero. A first and second auxiliary pulses for increasing the driving margin can be dispensed with, by setting the average of the information-signal voltage waveform to be approximately zero in the first information-signal voltage waveform. The elimination of these auxiliary pulses helps lower power consumption even further.

BRIEF DESCRIPTION OF THE DRAWINGS

FIG. 7 is a diagram showing the relationship between the application timings of the scanning selection signals and field scanning in the liquid crystal display apparatus according to yet another embodiment of the present invention.

FIG. 8 is a diagram showing the relationship between the application timings of the scanning selection signals and field scanning in the liquid crystal display apparatus according to yet another embodiment of the present invention.

FIG. 9 is a diagram showing the relationship between the application timings of the scanning selection signals and field scanning in the liquid crystal display apparatus according to yet another embodiment of the present invention.

DETAILED DESCRIPTION OF THE PREFERRED EMBODIMENTS

First Embodiment

Figure 1:
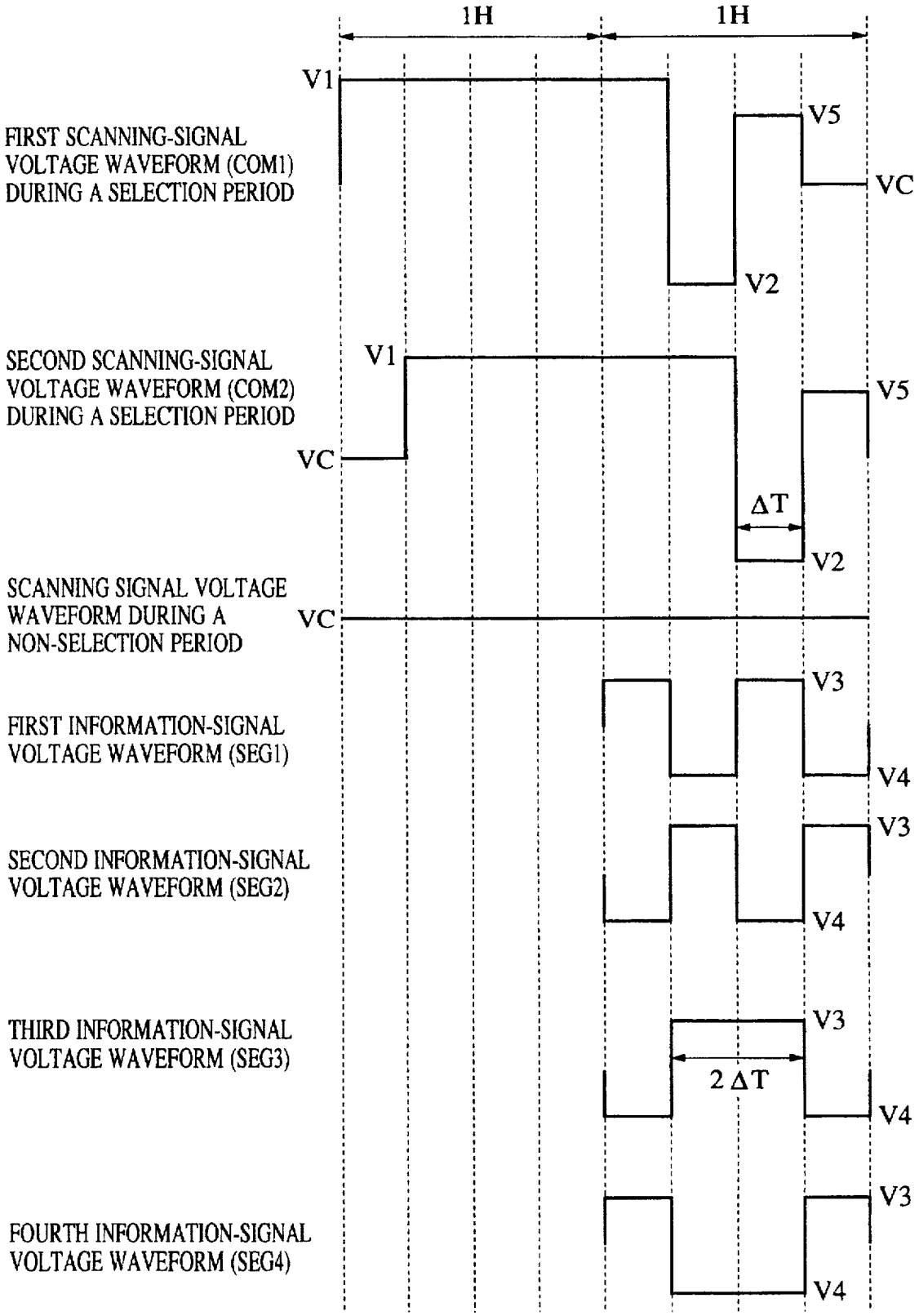
FIG. 1 is a waveform diagram showing the driving signal waveforms used in the liquid crystal display apparatus according to one embodiment of the present invention.
Figure 10:
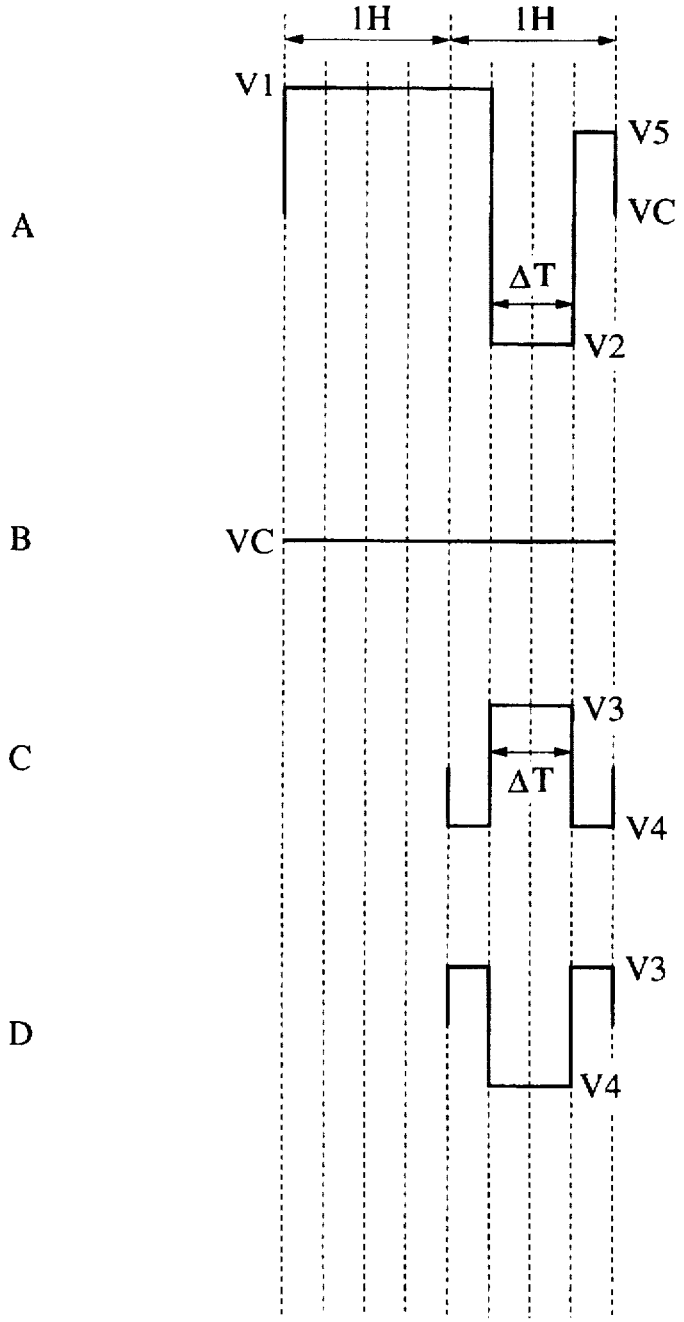
FIG. 10 PRIOR ART
FIG. 10 is a waveform diagram showing the driving waveforms used in the prior art display apparatus.

FIG. 1 shows the driving waveforms in a first embodiment of the present invention. Shown in FIG. 1 are a first scanning-signal voltage waveform (hereinafter COM1) for application during a selection period, a second scanning-signal voltage waveform (hereinafter COM2) for application during a selection period, a scanning-signal voltage waveform for application during a non-selection period, a first information-signal voltage waveform (hereinafter SEG1), a second information-signal voltage waveform (hereinafter SEG2), a third information-signal voltage waveform (hereinafter SEG3), and a fourth information-signal voltage waveform (hereinafter SEG4). 1H represents one horizontal scanning period, and ΔT represents selection time (light/dark selection time). 1H and ΔT are identical to those in connection with the prior art driving waveforms as shown in FIG. 10. The three scanning-signal voltage waveforms for application during a selection period shown in FIG. 1 are substantially identical in nature to corresponding waveforms in FIG. 10. At an initial V1 level (erase pulse), black erase (darkness write) is performed, and at a V2 level (write pulse), the selection of lightness/darkness (black/white) is performed with the information-signal voltage waveform at the V3 and V4 levels (selection pulses).

The first 1H of each scanning-signal voltage waveform is used to erase reliably pixels on a scanning electrode to which a waveform is applied. If the initial V1 pulse in the second 1H is capable of erasing sufficiently the pixel, the first 1H pulse is not required.

A V5 level correction pulse, which is applied as required, is used to increase the driving margin by performing correction as disclosed in Japanese Unexamined Patent Publication No. 2-281233.

Figure 2:
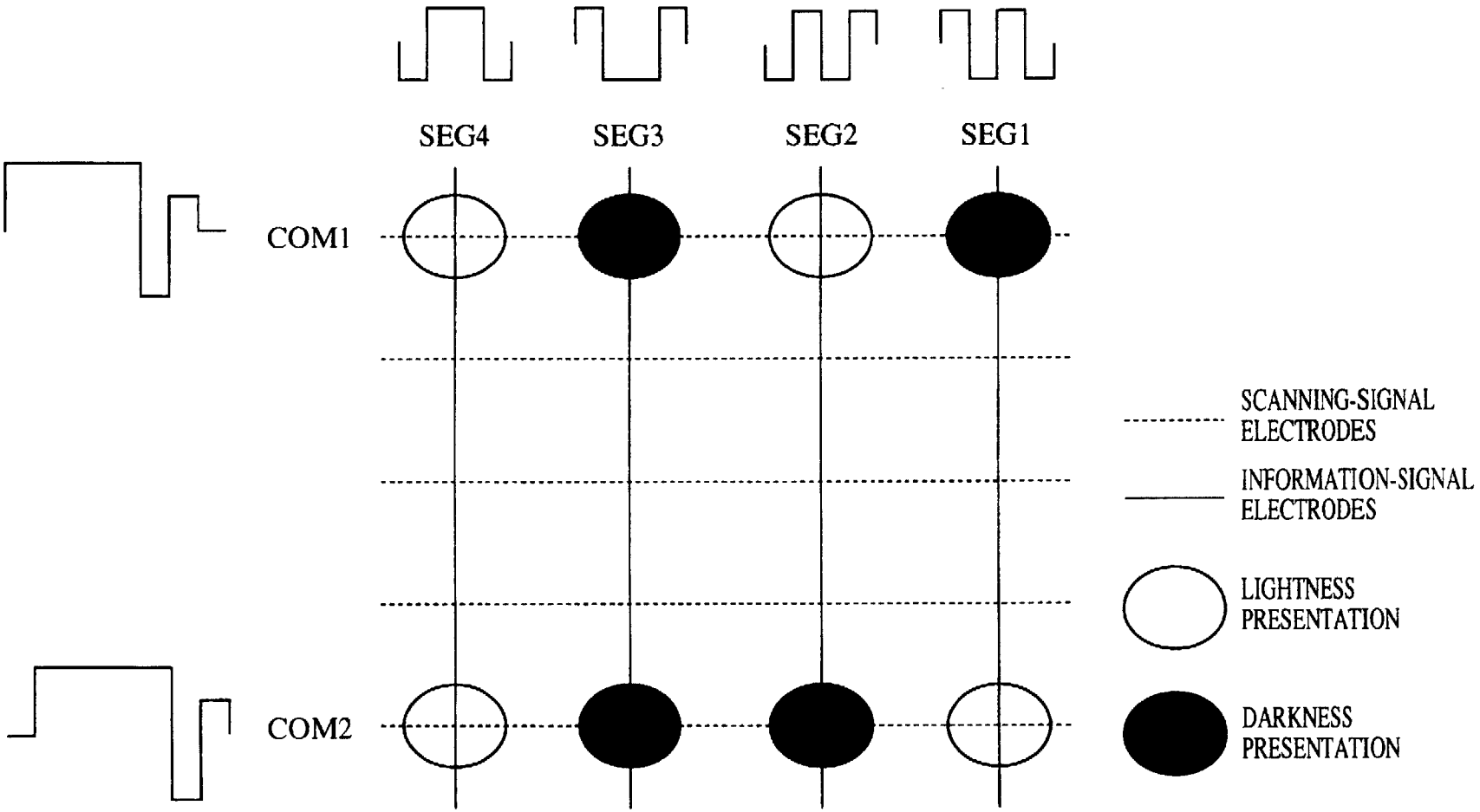
FIG. 2 shows pixels driven by the driving signals used in the liquid crystal display apparatus of the present invention.

As seen from FIG. 1, the erase pulse, write pulse and correction pulse in COM2 are shifted in phase by ΔT from those in COM1, respectively. In COM1, a VC level (reference voltage) follows the correction pulse, and in COM2, the VC (reference level) occurs before the erase pulse. Although depending on the direction of the optical axis of the polarizing plate of the liquid crystal panel, during each pulse duration (duration of V2) in the scanning-signal voltage waveform, a light display state is achieved by setting a V3 level and a dark display state is achieved by setting a V4 level in the information-signal voltage waveform. Specifically, as shown in FIG. 1, the combination of COM1 and SEG1 causes a dark display state to occur, and the combination of one of COM1 and COM2 with SEG2 causes a light display state. The combination of each of COM1 and COM2 with SEG1 causes opposite display states. SEG3 causes a light display state because SEG3 is at the V3 level in both the selection pulse periods of COM1 and COM2. The combination of one of COM1 and COM2 and SEG4 results in the opposite, namely, always results in a dark display state. FIG. 2 illustrates the light and dark display states which are present when two lines of scanning-signal electrodes not mutually adjacent in a matrix panel are selected and driven by the scanning-signal voltage waveforms and information-signal voltage waveforms according to the first embodiment of the present invention shown in FIG. 1. In the driving waveforms in this embodiment, even when two lines of scanning-signal electrodes concurrently scan, pixels on each information-signal electrode are allowed to take one of four combinations of display states [light, dark] (SEG2), [dark, light] (SEG1), [light, light] (SEG4), and [dark, dark] (SEG3).

The waveforms of the first embodiment of the present invention shown in FIG. 1 will now be compared with the prior art driving waveforms shown in FIG. 10. Suppose that the selection time ΔT is equal between both the first embodiment and in the prior art. 1H (horizontal scanning period) in the waveforms shown in FIG. 1 is twice as long as that in the driving waveforms shown in FIG. 10. Specifically, according to the waveforms in the first embodiment of the present invention, the updating of the pixels on one line of scanning-signal electrodes takes twice as long as that in the prior art driving waveforms. However, the driving waveforms in the first embodiment of the present invention update the pixels on two lines of scanning-signal electrodes within the duration of 1H. The time for updating one screen of the apparatus, and thus the frame frequency of the apparatus, remains the same as in the prior art. One horizontal scanning period, twice as long as that in the prior art, allows the frequency of the information-signal voltage waveform constantly applied to the information-signal electrodes to be halved. Thus, the load for driving the liquid crystal, which is greatly dependent upon the frequency of the information-signal voltage waveform, is substantially reduced. In the case of a degraded presentation quality arising from a load increase, for example, as a result of a light display state being presented on the entire screen, the power consumption of the apparatus is approximately halved. This reduces the heat generation of the liquid crystal, assures a sufficient margin in driving the liquid crystal in its high operating temperature region, and thus ensures presentation of a high-quality image.

Figure 3:
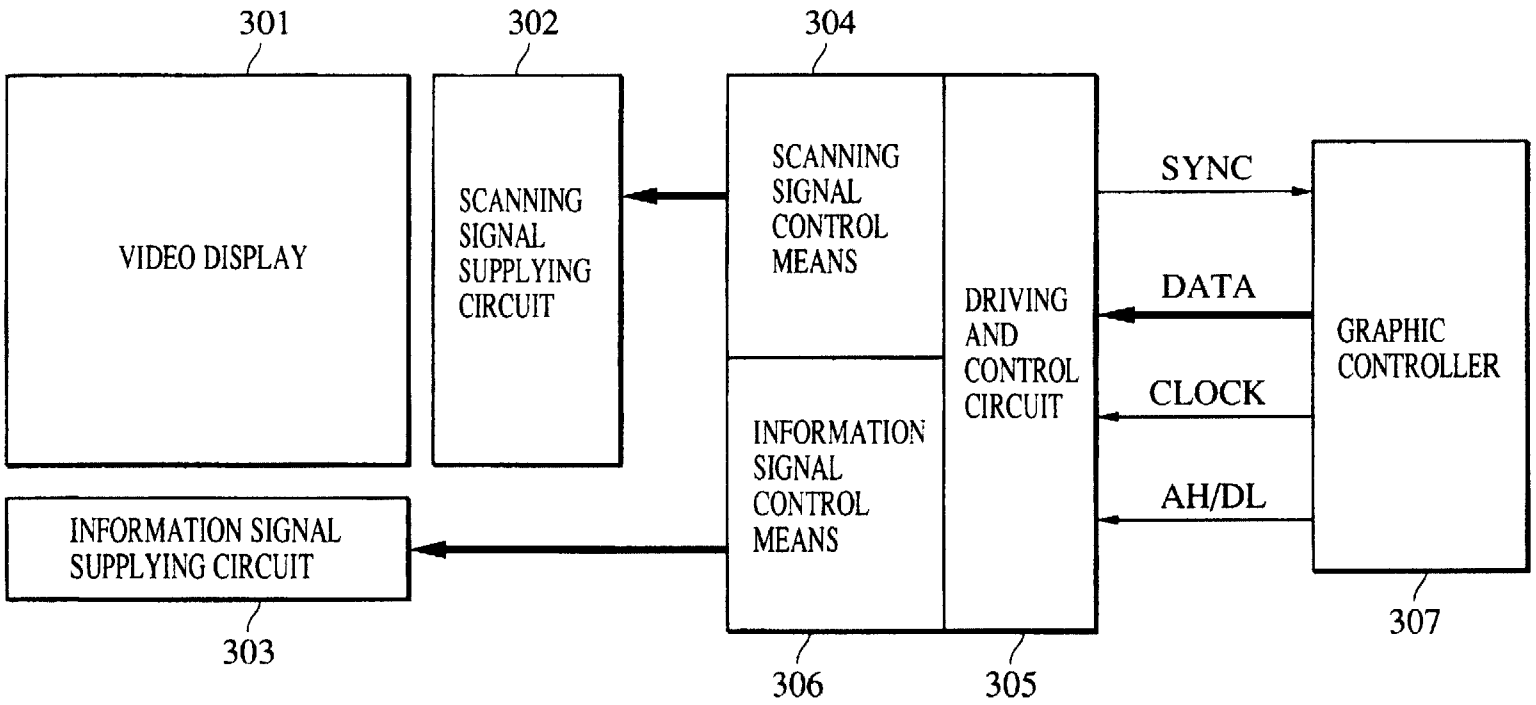
FIG. 3 is a block diagram of the control system of the liquid crystal display apparatus of the present invention.

FIG. 3 is the block diagram showing one embodiment of the present invention. As shown, a graphic controller 307 issues data associated with addresses to a driving and control circuit 305 having a frame memory. The driving and control circuit 305 converts data on each scanning line to be displayed, into address data and image data, and then transfers the data to scanning signal control means 304 and information signal control means 306. According to the address data, a scanning signal supplying circuit 302 generates the scanning-signal voltage waveform, and supplies it to a video display 301. According to the image data, an information signal supplying circuit 303 generates the information-signal voltage waveform, and supplies it to the video display 301.

Second Embodiment

The driving waveforms in a second embodiment of the present invention will now be discussed.

Figure 4:
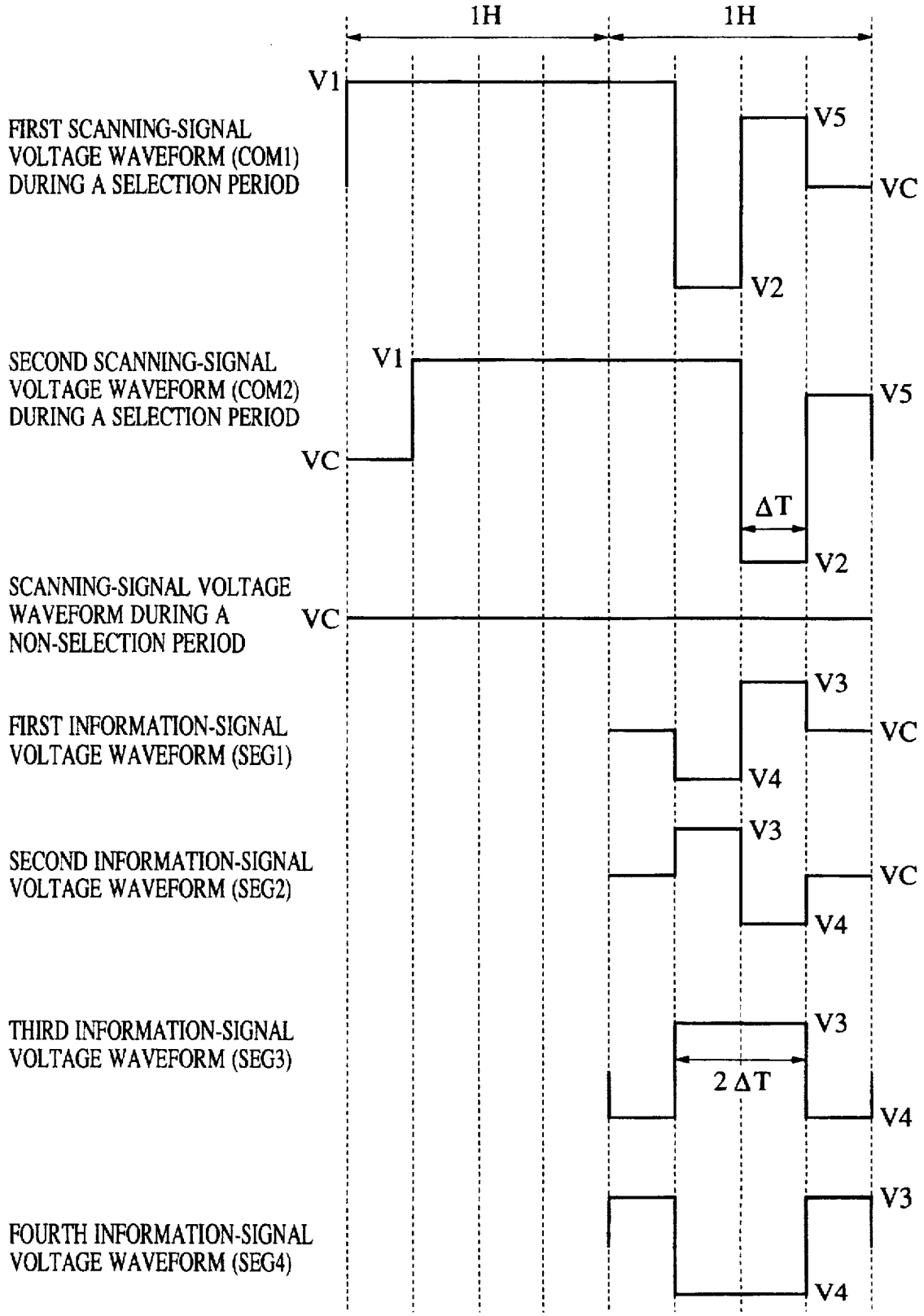
FIG. 4 is a waveform diagram showing the driving waveforms used in the liquid crystal display apparatus according to another embodiment of the present invention.

FIG. 4 shows the driving waveforms in the second embodiment. In this embodiment, the auxiliary pulses in the first and second information-signal voltage waveforms from FIG. 1 are set to a VC level. Compared with the information-signal electrodes being driven by the driving waveforms of the first embodiment, the power consumption is reduced as the auxiliary pulses are shifted from V3 and V4 levels to the VC level.

The rest of the arrangement in the second embodiment remains unchanged from that of the first embodiment.

Third Embodiment

Figure 5:
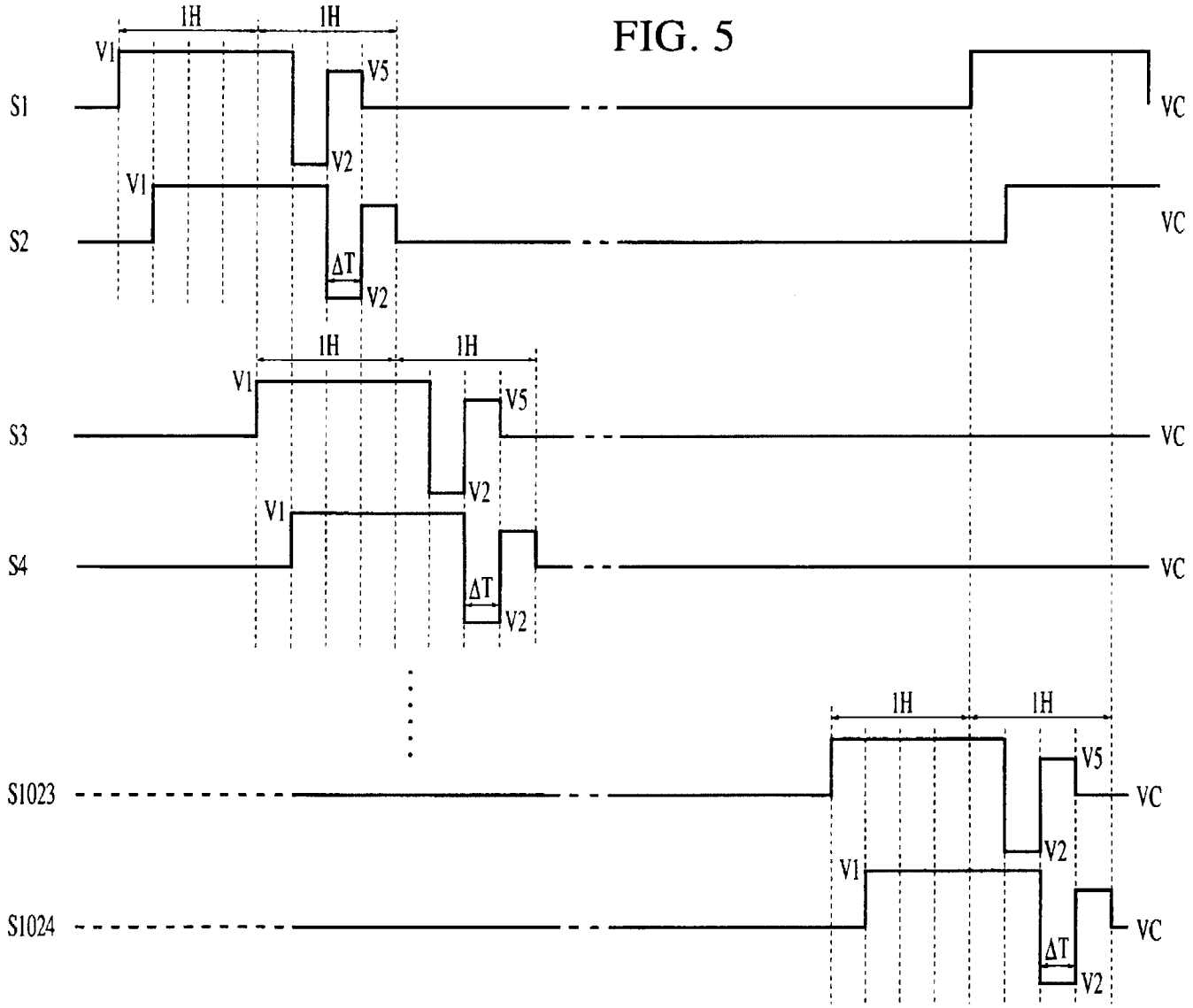
FIG. 5 is a waveform diagram showing the application timings of the scanning selection signals used in the liquid crystal display apparatus according to another embodiment of the present invention.

FIG. 5 shows the application timings of the scanning selection signals applied to the scanning electrodes in the liquid crystal display apparatus according to a third embodiment of the present invention.

The scanning selection signals or scanning-signal voltage waveforms are identical to those in the first embodiment, and are shown relative to the voltage that is applied to the scanning electrodes during a non-selection period.

In this embodiment, the pixels of the video display are arranged as 1280×1024, and the horizontal scanning lines number 1024, that is the lines of scanning electrodes are S1, S2, S3, . . . , S1023, and S1024.

In the first embodiment, the first and second scanning selection signals are concurrently applied to two lines of scanning electrodes that are not mutually adjacent. In the third embodiment, two adjacent scanning electrodes in combination (S1, S2), (S3, S4), . . . , (S1023, S1024) are concurrently driven by the scanning selection signals. During one period of 1H during which the presentation statuses of the pixels on the scanning electrodes (S1, S2) are determined, pulses for erasing the scanning electrodes (S3, S4) to be selected next are triggered, and then the erasing of the scanning electrodes (S3, S4) is performed.

In the same way, during another 1H period during which the presentation statuses of the pixels on the scanning electrodes (S3, S4) are determined, erase pulses are applied to the scanning electrodes (S5, S6), though this operation is not shown in FIG. 5.

Generally, when the scanning selection signals are applied to n-th and (n+1)-th electrode, erase pulses are applied to (n+2)-th and (n+3)-th electrodes.

The information-signal voltage waveforms shown in FIGS. 1 and 4 are also used herein in this embodiment.

Fourth Embodiment

Figure 6:
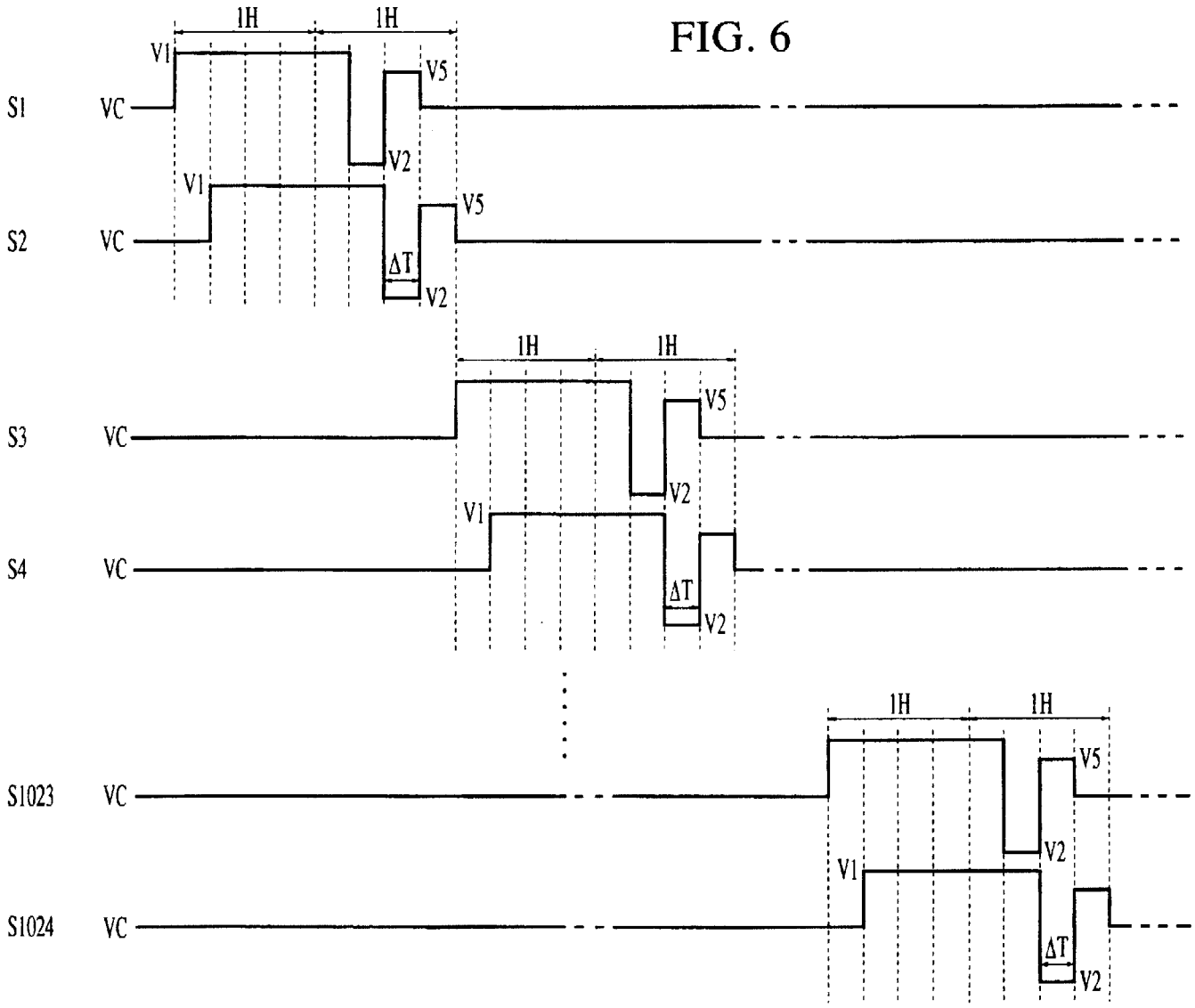
FIG. 6 is a waveform diagram showing the application timings of the scanning selection signals used in the liquid crystal display apparatus according to yet another embodiment of the present invention.

FIG. 6 shows the application timings of the scanning selection signals applied to the scanning electrodes in the liquid crystal display apparatus according to a fourth embodiment of the present invention.

Unlike the third embodiment shown in FIG. 5, the fourth embodiment shown in FIG. 6 uses the scanning selection signals in which the second 1H of the scanning selection signals applied to scanning electrodes is not superimposed on the first 1H of the scanning selection signals applied to other scanning electrodes.

Fifth Embodiment

FIG. 7 summarizes in a table the application timings of the scanning selection signals used in the liquid crystal display apparatus according to a fifth embodiment of the present invention.

In the fifth embodiment shown in FIG. 7, the first and second scanning selection signals (COM1 and COM2) are concurrently applied to two adjacent scanning electrodes.

In FIG. 7, four fields constitute one frame of a screen. In a first field, scanning selection signals (COM1 and COM2) are applied to (8n+1)-th and (8n+2)-th scanning electrodes, respectively.

Selected in a second field are two scanning electrodes, (8n+5)-th and (8n+6)-th, which are not adjacent to the scanning electrodes that have been selected in the preceding field.

In a third field, (8n+3)-th and (8n+4)-th scanning electrodes are selected, and in a fourth field, (8n+7)-th and (8n+8)-th scanning electrodes are selected.

This method outperforms the method illustrated in FIG. 6 in controlling flickering effect.

If, as shown in FIG. 5, the first 1H of the scanning selection signals that are applied to the scanning electrodes to be selected later is superimposed on the second 1H of the scanning selection signals that are applied to the electrodes that have been selected, with the scanning electrodes selected as in the sequence listed in FIG. 7, the scanning period is further halved, thereby making the flickering effect less visible.

Sixth Embodiment

FIG. 8 summarizes in a table the application timings of the scanning selection signals used in the liquid crystal display apparatus according to a sixth embodiment of the present invention.

In the sixth embodiment shown in FIG. 8, the first and second scanning selection signals (COM1 and COM2) are concurrently applied to two scanning electrodes that are not adjacent.

Four fields constitute one frame of a screen. In a first field, scanning selection signals (COM1 and COM2) are applied to (8n+1)-th and (8n+5)-th scanning electrodes, respectively.

Selected in a second field are two scanning electrodes, (8n+2)-th and (8n+6)-th, which are adjacent to the scanning electrodes that were selected in the first field.

In a third field, (8n+3)-th and (8n+7)-th scanning electrodes are selected, and in a fourth field, (8n+4)-th and (8n+8)-th scanning electrodes are selected.

Seventh Embodiment

FIG. 9 summarizes in a table the application timings of the scanning selection signals used in the liquid crystal display apparatus according to a seventh embodiment of the present invention.

In FIG. 9, the first and second scanning selection signals (COM1 and COM2) are concurrently applied to two scanning electrodes that are not adjacent to each other.

Four fields constitute one frame of a screen. In a first field, scanning selection signals (COM1 and COM2) are applied to (8n+1)-th and (8n+5)-th scanning electrodes, respectively.

Selected in a second field are two scanning electrodes, (8n+3)-th and (8n+7)-th, which are not adjacent to the scanning electrodes that were selected in the preceding field.

In a third field, (8n+4)-th and (8n+8)-th scanning electrodes are selected, and in a fourth field, (8n+2)-th and (8n+7)-th scanning electrodes are selected.

This method outperforms the methods shown in FIGS. 7 and 8 in controlling the flickering effect.

If, as shown in FIG. 5, the first 1H of the scanning selection signals that are applied to the scanning electrodes to be selected later is superimposed on the second 1H of the scanning selection signals that are applied to the electrodes that have been selected, with the scanning electrodes selected as in the sequence listed in FIG. 7, the scanning period is further halved, thereby making the flickering effect less visible.

As described above, according to each of the above embodiments of the present invention, the liquid crystal display apparatus comprises a liquid crystal display panel having scanning-signal electrodes and information-signal electrodes, information electrode driving means for applying an information-signal voltage waveform to the information-signal electrodes, and scanning electrode driving means for applying a scanning-signal voltage waveform to the scanning-signal electrodes, whereby the information-signal voltage waveform applied to the information-signal electrodes is constructed of a first information-signal voltage waveform comprising a first information pulse having a pulse length of ΔT, and a second information pulse following the first information pulse, having a polarity opposite the polarity of the first information pulse and having a pulse length of ΔT, and a second information-signal voltage waveform comprising a third information pulse having a pulse length of 2ΔT, the scanning-signal voltage waveform applied to the scanning-signal electrodes is constructed of a first scanning-signal voltage waveform comprising a first write pulse having a pulse length of ΔT and a first erase pulse prior to the first write pulse, and a second scanning-signal voltage waveform, phase-shifted off the first scanning-signal voltage waveform by ΔT, comprising a second write pulse having a pulse length of ΔT and a second erase pulse prior to the second write pulse, the first and second scanning-signal voltage waveforms cause two lines of scanning-signal electrodes to scan concurrently on the liquid crystal panel, and one of the first and second information-signal voltage waveforms is applied to each information-signal electrode in response to the presentation status of the information-signal electrode. In the case of anti-ferroelectric liquid crystal device application, it is necessary to add a positive or negative offset voltage to the reference voltage VC. The apparatus thus presents a high-quality image with a lower power consumption.

What is claimed is:

1. A liquid crystal display apparatus comprising:

a liquid crystal display panel having scanning-signal electrodes, information-signal electrodes and a liquid crystal, information electrode driving means for applying an information-signal voltage waveform to the information-signal electrodes, and scanning electrode driving means for applying a scanning-signal voltage waveform to the scanning-signal electrodes, wherein:

said scanning electrode driving means generates a first scanning-signal voltage waveform comprising a first write pulse having a pulse length of ΔT and a first erase pulse just prior to the first write pulse, and a second scanning-signal voltage waveform, phase-shifted from the first scanning-signal voltage waveform by ΔT, comprising a second write pulse having a pulse length of ΔT and a second erase pulse just prior to the second write pulse, so that two lines of scanning-signal electrodes are scanned and selected sequentially within the same scanning period according to the first and second scanning-signal voltage waveforms; and said information electrode driving means selectively applies a first information-signal voltage waveform comprising a first information pulse having a pulse length of ΔT, and a second information pulse following the first information pulse, having a polarity opposite the polarity of the first information pulse and having a pulse length of ΔT, and a second information-signal voltage waveform comprising a third information pulse having a pulse length of 2ΔT.

2. A liquid crystal display apparatus according to claim 1, wherein the liquid crystal is a ferroelectric liquid crystal.

3. A liquid crystal display apparatus according to claim 1, wherein the liquid crystal is an anti-ferroelectric liquid crystal.

4. A multiplex driving method for driving a liquid crystal display apparatus having a plurality of first and second scanning electrodes each having pixels thereon, and a plurality of information electrodes, said method comprising the steps of:

applying a write pulse having a pulse length of ΔT to the first scanning electrodes during a first duration and applying a write pulse having a pulse length of ΔT to the second scanning electrodes during a second duration that is in succession to the first duration; and applying an information signal to the information electrodes during the first and second durations to determine the presentation statuses of the pixels on the first and second scanning electrodes within one horizontal scanning period, wherein one of four types of signals is selected as the information signal in accordance with the presentation statuses of the pixels and is applied to one of the information electrodes, and the four types of signals comprise first and second voltage waveforms being different in phase to each other, each of the first and second voltage waveforms having opposite polarities from the first duration to the second duration, and the third and fourth voltage waveforms being opposite in polarity to each other and each of the third and fourth voltage waveforms having the same polarity over the first duration and the second duration.

5. A method according to claim 4, wherein the write pulses are applied to two different scanning electrodes within an immediately subsequent horizontal scanning period.

6. A method according to claim 4, wherein erase pulses are applied to two different scanning electrodes within the one horizontal scanning period.

7. A method according to claim 4, wherein scanning electrodes that are not mutually adjacent are concurrently selected within the one horizontal scanning period.

8. A method according to claim 4 or 7, wherein a pair of scanning electrodes that are not mutually adjacent are sequentially selected within two consecutive horizontal scanning periods.

9. A method according to claim 4, wherein erase pulses are concurrently applied to two selected scanning electrodes within the one horizontal scanning period.

* * * * *